US005327751A

United States Patent [19]

Biagi

[11] Patent Number: 5,327,751

[45] Date of Patent: Jul. 12, 1994

[54] CLOTHES DRY-CLEANING MACHINE

[75] Inventor: Gino Biagi, Calderara di Reno, Italy

[73] Assignee: Firbimatic S.r.l., Bologna, Italy

[21] Appl. No.: 18,792

[22] Filed: Feb. 17, 1993

[30] Foreign Application Priority Data

Feb. 18, 1992 [IT] Italy ..... BO92A000056

[51] Int. Cl.[5] ..... D06F 43/08

[52] U.S. Cl. ..... 68/18 C; 68/18 F

[58] Field of Search ..... 68/18 R, 18 F, 18 C

[56] References Cited

U.S. PATENT DOCUMENTS

| | | | |
|---|---|---|---|
| 3,110,544 | 11/1963 | Moulthrop | 68/18 R |
| 3,206,950 | 9/1965 | Xeros | 68/18 R X |
| 3,391,550 | 7/1968 | Williams | 68/18 C X |
| 3,728,074 | 4/1973 | Victor | 68/18 C X |
| 4,774,821 | 10/1988 | Luppi et al. | 68/18 C |

FOREIGN PATENT DOCUMENTS

| | | | |
|---|---|---|---|
| 0155919 | 9/1985 | European Pat. Off. | B01D 3/00 |
| 0239663 | 10/1987 | European Pat. Off. | D06F 43/08 |
| 2538010 | 6/1984 | France | D06F 73/08 |

*Primary Examiner*—Philip R. Coe
*Attorney, Agent, or Firm*—Darby & Darby

[57] ABSTRACT

A dry cleaning clothes machine includes a washing barrel having an inlet, an outlet and a door to sealingly close the barrel. A preheating condensation chamber of distilled solvent is coupled to a first cooling circuit for the distilled vapors of the solvent arriving from a second container tank. A cooling chamber for the solvent comprises a section of a second circuit. The solvent is delivered from a third tank to the cooling chamber. An outlet of the second circuit is connected to a separation chamber and an outlet of the separation chamber is connected to the first and third tanks. The cooling chamber further includes the section of a third through circuit inside of which a refrigerating liquid flows.

6 Claims, 1 Drawing Sheet

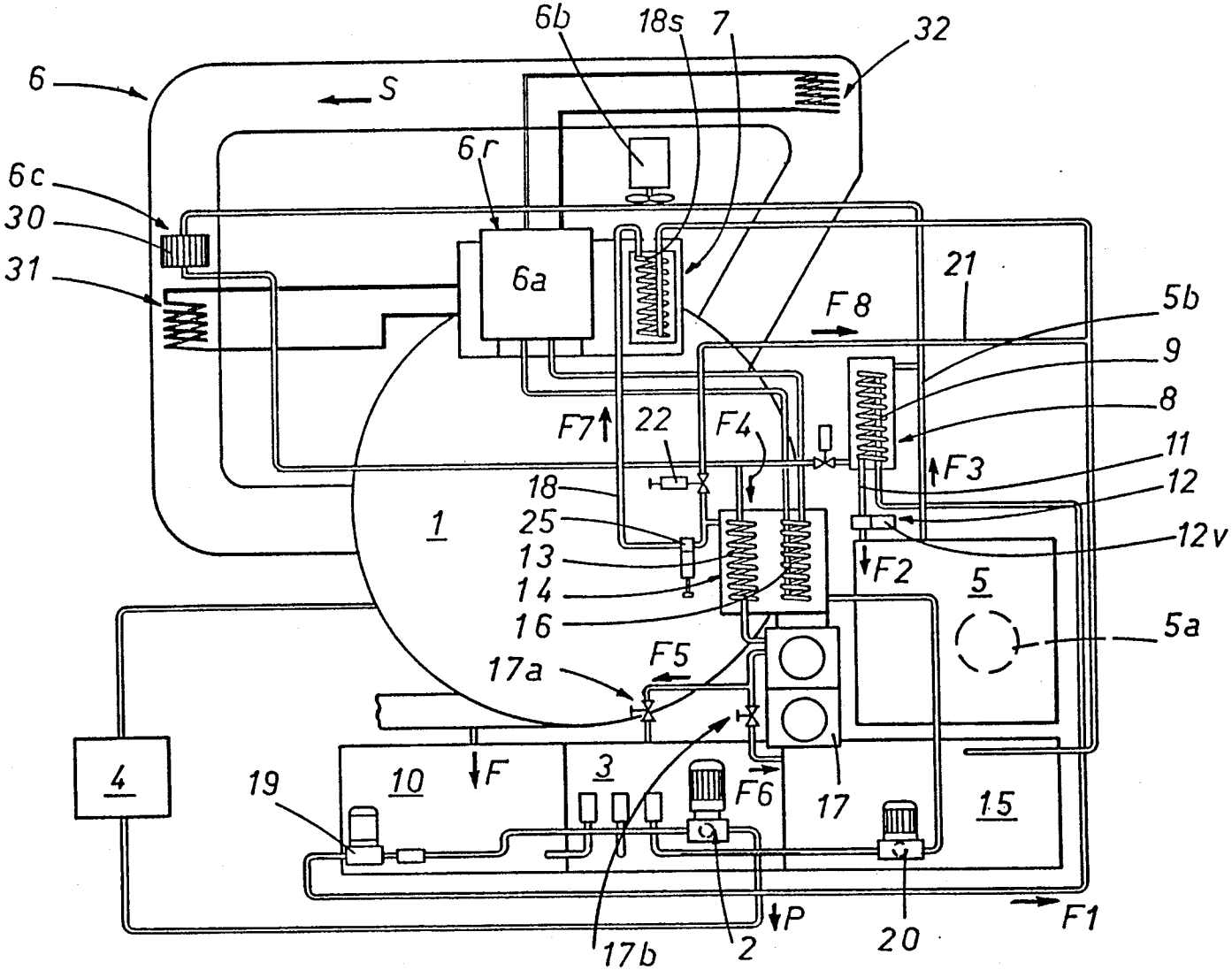
5b
9
8
11
12
12v
5a
F1
21
F3
5
15
32
F2
20
F8
17
P
7
F4
F6
2
18s
22
F5
17b
3
6b
F7
18
25
13
14
16
17a
6a
6r
F
1
10
S
19
4
6
6c
30
31

CLOTHES DRY-CLEANING MACHINE

BACKGROUND OF THE INVENTION

The invention relates to a clothes dry-cleaning machine.

In the design and realisation of dry-cleaning machines for clothes there is a continual need to make technical improvements and pay even greater heed to the ecological norms required by law, while keeping the work rate and quality high.

At present machines exist which perform dry-cleaning by following a continuous distillation process, with practically all of the functioning devices closed in an internal closed circuit. The only two connections with the outside are the electric power connection for the principal apparatus (for example, motor compressors) and a water-supply connection for the cooling of the vapour condenser and for the cooling circuit cooling.

More precisely, the water (coming from the principal acqueduct or well and channelled into appropriate conduits) passes through small tubes, possibly equipped with fins, arranged internally to a case, which case defines the collection tank of the distilled solvent vapours, which can thus condensate and be recuperated: the water, circulating in other appropriate conduits, serves as a cooling element for the condenser of the general cooling circuit of the machine.

The drawbacks of such a connection are the following: the positioning of the machine inside the building, which obviously must be such as to enable an easy link-up to the water supply; the considerable volume of water used for the various cooling operations after each cleaning cycle with consequent high running costs, and a further, ecological problem, caused by the need to dispose of the water used by the machine, apart from the problem of actually finding a water supply that can provide the quantities of water needed.

SUMMARY OF THE INVENTION

The aim of the present invention is that of obviating the above-mentioned drawbacks through the realisation of a dry-cleaning machine with an autonomous solvent-cooling and general circuit condenser cooling device, which device runs in a closed circuit internally to the machine and uses in part the cleaning solvent.

BRIEF DESCRIPTION OF THE DRAWINGS

The technical characteristics of the invention, according to the above-mentioned aims, and the advantages of the invention will be better evidenced in the detailed description that follows, made with reference to the accompanying figure which shows a block diagram of the machine of the present invention, in an embodiment to be considered purely in the form of a non-limiting example.

DESCRIPTION OF THE PREFERRED EMBODIMENT

With reference to the figure, the clothes dry-cleaning machine comprises, in its essential parts inherent to the invention, a circular-section barrel 1 for dry-cleaning, which barrel 1 is connected by a sealed door (not illustrated) to the outside, while on the other side it is supplied by first pump 2 preferably an aspiration pump, from a first tank 3 containing solvent and equipped with a filtering element 4, such as for example a cartridge filter, or alternatively ecological nylon discs.

The cleaning barrel 1 is also connected to a distillation and cleaning chamber 5 by means of evaporation of the solvent used in the barrel 1, using autonomous heating means 5*a* (for example, electrical resistance elements): the chamber 5 is indirectly connected to the first tank 3.

A drying circuit 6 is also envisaged for drying the clothes, functioning by closed-circuit air circulation according to a direction S. The circuit 6 comprises, arranged one downstream of the other, a refrigeration cooling system 6*r* equipped with a compressor 6*a* to permit the flow of refrigerating liquid (for example, freon) to the zone to be cooled, a coil-tube heat-exchanger 32 and a condenser 7 for the cooling of the refrigerating liquid already in circulation by means of for example a fan 6*b* in such a way as to condense the solvent exiting from the barrel 1.

The circuit further comprises a heating system 6*c* comprising a main heat exchanger 30 and an auxiliary heat exchanger 31 connected in closed circuit to the distillation chamber 5 to permit the drying of the clothes.

The machine illustrated in the accompanying figure comprises a pre-heating-condensation chamber 8 of the solvent, which is crossed by a first through-circuit 9, constituted in the internal zone of the pre-heating-condensation chamber 8 by a coil-tube heater, inside which flows the solvent arriving from a second container tank 10 of the solvent used during the cycle and exiting from the barrel 1, which solvent is already at atmospheric temperature. Through this first circuit 9 the distillation chamber 5 is supplied, also by means of a first conduit 11 equipped with valve means 12 which terminates in the said distillation chamber 5, but which valve means 12 also supply the chamber 5 according to the quantity present in the chamber 5. The valve means 12 is constituted by a timer valve 12*v* aimed at supplying the distillation chamber 5 with the solvent, by means of discontinuous jets of heated solvent into the chamber (a sort of injection-supply), and according to the requirement of the machine (that is, washing or pre-washing).

In its turn the distillation chamber 5 directly supplies the pre-heating-condensation chamber 8, by means of a relative conduit 5*b*, with the vaporised solvent exiting from the chamber, through a relative second circuit 13, passing through the pre-heating-condensation chamber 8 and across a solvent cooling chamber 14; internal to the solvent cooling chamber 14 there is some solvent at atmospheric temperature arriving from a further, third tank 15 (of greater capacity with respect to the previous ones) for the accumulation and containment of the solvent and a third through-circuit 16 inside which the abovementioned refrigerating liquid coming directly from the compressor 6*a* flows.

The second circuit 13 (which is also a coil tube heat-exchanger internally to the cooling chamber 14 together with the third circuit 16) is in its turn connected to a separation chamber 17 of the cooled and cleaned solvent and is connected at its outlet both with the first tank 3 and with the third 15 tank in such a way as to supply, through special valves 17*a* and 17*b*, the tanks with the solvent according to the requirements of the machine. The cooling solvent, on the other hand, outlets from the cooling chamber 14 through a second conduit 18 passing across the above-mentioned condenser 7 (in which the conduit 18 is equipped with a further coil tube heat exchanger 18*s*), so as to permit of an eventual further cooling of the refrigerating liquid of the cooling system 6*r*, and then terminates, at its end, internally to the third tank 15, to be reintegrated with the solvent. The said second conduit 18 is equipped both with second valve means 25, which permit its opening in accordance with the cooling requirements of the freon and with a further branching conduit 21, controlled by further, third valve means 22, which conduit 21 permits the solvent to pass directly from the cooling chamber 14 to the third tank 15 without flowing internally to the condenser 7.

Naturally both the second 10 and the third 15 tanks are equipped with second pump means 19 and 20, both constituted by pumps, so as to permit the solvent to flow externalwise from them.

As can be deduced from the above description, the dry-cleaning machine functions in the following way at least as far as the internal heating and cooling circuits are concerned: after the pre-washing phase of the clothes contained in the barrel 1 has been concluded, using the clean solvents coming from the first tank 3 (see arrow P), or alternatively from the third tank 15 the now-dirty solvents are removed (arrow F) at atmospheric temperature (about 18–20 degrees) internally to the second tank 10; from here the said dirty solvents are taken and sent towards the pre-heating-condensation chamber 8 (see arrow F1), passing through the through-circuit tube heat-exchanger 9 and according to necessity are made to flow inside the distillation chamber 5 (see arrow F2). Inside the distillation chamber 5 the dirty solvents are purified by means of evaporation and are sent (at a temperature of about 121 degrees Celsius) inside the pre-heating-condensation chamber 8 (see arrow F3), in which the hot solvent undergoes a first drop in temperature, thanks to the dirty solvent at atmospheric temperature flowing in the heat-exchanger 9.

Subsequently the solvent reaches the solvent cooling chamber 14 at a temperature of about 95 degrees (see arrow F4) where it is cooled by the selfsame solvent flowing from the third tank 15 at a temperature of about 5–10 degrees and thanks also to the third heat-exchanger 16 (since the first tank alone is not sufficient) wherein the refrigerating liquid flows (in effect a second, closed-circuit condenser). Thus the cooled and cleaned solvent (at about a temperature of 30 degrees) can flow into the separation chamber 17 which divides it between the first 3 and third tanks 15 according to the cleaning needs of the machine (see arrows F5 and F6).

The cooling solvent flowing out of the cooling chamber 14 is sent to the second conduit 18 (see arrow F7) in order to return to the third tank 15; in the second conduit 18 the solvent, making a longer circuit, can cross the cooling condenser 7 for the refrigerating liquid to speed up the cooling phase (this passage becomes necessary in the critical functioning moments at full power of the entire cooling system when the fan 6*b* alone is not sufficient), or, if this phase is not necessary, the solvent can be de-routed more quickly towards the third tank 15 across the branching conduit 21 (see arrow F8).

Thanks to this type of machine it is possible to have all of the solvent cooling phase contained in a closed circuit, without the need to link up to external water sources, since the cooling is achieved thanks principally to the use of other, cooler solvent; this factor makes possible a considerable user-saving as well as a speeding-up of the cleaning cycles.

What is claimed is:

1. A machine for dry-cleaning clothes comprising: at least one washing barrel having an inlet, an outlet and a door to sealingly close said barrel; first pump means for supplying solvent from at least a first tank, through at least one filter element to said barrel inlet; a distillation chamber being in fluid communication with said barrel outlet, said distillation chamber including means for evaporating by autonomous heating of said solvent; a closed air-circulation drying circuit comprising a refrigerated cooling system having at least one condenser for condensing, by using a refrigerating liquid, the solvent exiting from said barrel, said cooling system being downstream, with respect to the air circulation direction, of a heating system for the drying of said clothes contained in said barrel; a pre-heating condensation chamber of said distilled solvent being coupled to a first cooling circuit for the distilled vapours of the solvent arriving from a second container tank, said solvent being the same as that used in a cycle, at atmospheric temperature, exiting from said barrel, said first circuit supplying said distillation chamber through a first conduit equipped with a first valve means for supplying said distillation chamber in accordance with the quantities already present in said distillation chamber; an inlet of said pre-heating condensation chamber being connected, to said distillation chamber and an outlet of said pre-heating condensation chamber being connected to a second circuit; a cooling chamber of said solvent comprising a section of said second circuit, said solvent being delivered from a third tank to an inside of said cooling chamber, an outlet of said second circuit being connected to a separation chamber, an outlet of said separation chamber being connected to said first and third tanks and supplying said first and third tanks with said cooled distilled solvent in accordance with the needs of said machine; said cooling chamber further comprising a section of a third through-circuit inside of which a refrigerating liquids flows, said third circuit being part of said cooling circuit; an outlet of said cooling chamber delivering cooling solvent from said cooling chamber, via a second conduit, through a heat-exchanger and through said condenser of said refrigeration cooling system so as to permit a further cooling of said refrigerating liquid, and said cooling solvent terminating inside said third tank; second valve means being disposed within said second conduit and being controlled to open said second conduit in accordance with a cooling request on the part of said condenser; and second pump means, acting at least on said second and third tanks, for permitting a flow from said second and third tanks of said solvent.

2. A machine as in claim 1, wherein said second conduit is equipped with a branching conduit controlled by a third valve means for permitting a passage from said cooling chamber to said third tank of said solvent external to said condenser.

3. A machine as in claim 1, wherein each of said first, second and third through-circuits is defined, at least at their inlet into said pre-heating condensation chamber and respectively into said cooling chamber, by a coil-tube heat-exchanger.

4. A machine as in claim 1, wherein said first valve means is a timer valve for supplying, by discontinuous jets of said solvent, in accordance with the requirements of said machine, said distillation chamber with said solvents.

5. A machine as in claim 1, wherein the first and the second pump means are constituted by a pump for each of said tanks so as to permit the outflowing of the said solvent from the said tanks.

6. A machine as in claim 1, wherein said heating system includes a heat exchanger to constitute a heat pump of said refrigerating system and by an auxiliary heat exchanger connected, in closed circuit, to said distillation chamber.

* * * * *